United States Patent [19]

Umemura et al.

[11] Patent Number: 4,491,958

[45] Date of Patent: Jan. 1, 1985

[54] SPEECH SYNTHESIZER

[75] Inventors: Kazuhiro Umemura; Tohru Sampei, both of Yokohama; Kazuo Nakata, Kodaira; Hirokazu Sato, Yokosuka; Murakami Kenya, Yokosuka; Kiyoshi Intoh, Yokosuka, all of Japan

[73] Assignees: Nippon Telegraph & Telephone Public Corporation; Hitachi, Ltd., both of Tokyo, Japan

[21] Appl. No.: 314,839

[22] PCT Filed: Feb. 17, 1981

[86] PCT No.: PCT/JP81/00031

§ 371 Date: Oct. 22, 1981

§ 102(e) Date: Oct. 22, 1981

[87] PCT Pub. No.: WO81/02489

PCT Pub. Date: Sep. 3, 1981

[30] Foreign Application Priority Data

Feb. 22, 1980 [JP] Japan ..... 55-20597

[51] Int. Cl.[3] ..... G10L 1/00

[52] U.S. Cl. ..... 381/51

[58] Field of Search ..... 179/1 SA, 1 SM; 364/513, 513.5; 381/29-35, 51-53

[56] References Cited

U.S. PATENT DOCUMENTS

B 476,577 1/1976 Flanagan ..... 179/1 SM 4,328,395 5/1982 Henderson ..... 179/1 SM

*Primary Examiner*—E. S. Matt Kemeny

*Attorney, Agent, or Firm*—Antonelli, Terry & Wands

[57] ABSTRACT

In a speech synthesizer designed so that natural speech is chopped at constant intervals of time and characteristic parameters of the speech are extracted from the chopped speech and used for synthesis of speech, the number of bits of a characteristic parameter per analytical frame is not changed, but the interval of time of one analytical frame is changed to change the amount of information per unit time, while the time interval of one synthesis frame of the synthesizer is changed with the time interval of one analytical frame so that the time interval of one frame upon analysis and the time interval of one frame upon synthesis are made equal, whereby a single speech synthesizer can handle speech parameters of different amounts of information.

1 Claim, 3 Drawing Figures

SPEECH SYNTHESIZER

TECHNICAL FIELD

This invention relates to speech synthesizers and particularly to a speech synthesizer for synthesizing speech on the basis of a parameter signal indicative of the frequency spectrum envelope of a speech signal and information indicating the period of a speech signal.

BACKGROUND ART

In the information service network for offering information such as stock market conditions, weather forecasts, guidance on various exhibitions and so on in the form of speech, it is desired that different kinds of information are transmitted on a digital signal to the terminal equipment of the network, where the digital signal is converted to speech by a speech synthesizer. In a teaching machine, vending machine, anouncment apparatus for giving announcements at a meeting and so on where a small number of spoken words are used, a speech synthesizer can be used which employs a semiconductor memory instead of a magnetic recording tape which has been used to date.

In a digital speech synthesizer in which speech signals are converted to digital signals and then stored and the stored digital signals are combined in such a manner as to form speech, a continuous speech signal is chopped at constant time intervals and characteristic parameters of the speech are extracted from the chopped speech waveforms. These parameters are converted to digital signals and stored. The stored parameters are combined in such a manner as to form speech. Thus, a speech unit of the synthesized sound can be reduced to a monosyllable shorter than a word. This permits a number of words to be formed without increase of the memory capacity. In addition, such a speech synthesizer has no mechanically movable portions and therefore does not cause any trouble due to wear or the like so that the maintenance thereof is easy.

It is thus preferable that a speech synthesizer synthesizes speech on the basis of the characteristic parameters of speech for easy maintenance and small memory capacity.

Since the spectrum distribution of speech is changed by the natural movement of the voice modifying organs such as the tongue and the lips, the change of the spectrum distribution is gentle, and during a short period of time in the range of 10 to 3 m seconds it can be considered to be substantially stationary. Thus, the characteristics of the spectrum of speech are derived precisely from the spectrum of speech during this stationary period of time, thereby to enable the analysis of speech, and synthesis of speech on the basis of the extracted information. For analysis and synthesis of speech, it is necessary to derive from the speech spectrum during the short period of time in which the change of distribution of the speech spectrum can be considered to be stationary, a parameter indicative of the envelope of the spectrum, a parameter indicative of the amplitude of the speech signal, pitch information corresponding to the fundamental vibration frequency of the vocal chords, and discrimination information for indicating a voiced sound or an unvoiced sound.

One of the speech analysis and synthesis systems for the extraction of the characteristic parameters from speech signals, and for synthesizing the speech signals on the basis of the parameters is a PARCOR type method using PARCOR coefficients (partial auto-correlation coefficients) as a kind of a linear prediction coefficient.

The apparatus utilizing this method produces PARCOR coefficients as the characteristic parameters of speech signals. That is, a speech signal during a short period of time in which the change of the frequency spectrum of the speech signal is gentle and stationary is sampled at a sampling period of, for example, 8 kHz. The samples at two close points, of the successive samples are estimated by the least squares of the samples existing between those at the two points. The predicted values are compared with the actual sample values at the two points and then the correlation (PARCOR coefficients) among the resulting differences are determined. In the speech synthesizer, a signal generator for generating white noise and a pulse is used as a sound source. The amplitude of the output signal from the sound source is controlled by the PARCOR coefficients as set forth above to have a correlation. Thus, the frequency spectrum envelope is reproduced to enable the speech synthesis.

This PARCOR type speech analysis and synthesis method can handle the PARCOR coefficient, pitch information, amplitude information and discrimination information for discriminating between voiced sound and silent sound in binary values. These kinds of information can be stored in a semiconductor memory. In addition, the binary information can be transmitted through telephone channels.

For analysis of speech and extraction of characteristic parameters of speech, the speech is sampled during a short period of time as described above. This short period of time is generally called the analytical frame or simply the frame. From one frame is extracted a PARCOR coefficient, pitch information, amplitude information, and discrimination information for discriminating between voiced and unvoiced sounds. The information per frame is transferred in 96 bits, for example. If one frame corresponds to 20 m second, this amount of information is 4800 bits/second, and if one frame is 10 m second, it is 9600 bits/second.

The speech synthesizer for synthesizing speech on the basis of speech parameters obtained by analysis of the speech provides a synthesized speech the quality of which is determined by the amount of information for use in the synthesis. For example, the sound quality in the case of 9600 bits/sec. at which the speech parameters obtained by analysis of speech are transmitted is apparently better than that in the case of 4800 bits/sec. However, while the amount of information of 9600 bits/sec. satisfactorily provides better sound quality when there are more idle channels in the digital telephone, the 4800 bits/sec. will rather increase the utilizing efficiency of channel when there are few idle channels, although the sound quality is slightly deteriorated. When the speech information is stored in a semiconductor memory or the like, the amount of information to be decided depends on which of the sound quality and the memory capacity is first taken into account.

The conventional speech synthesizer can handle only a fixed amount of speech information per unit time and cannot handle a different amount of speech information. For example, the speech synthesizer capable of 9600 bits/ sec. cannot process speech information at 4800 bits/sec. Therefore, the amount of information per unit time cannot be changed in accordance with the extent to which the telephone channel is crowded with calls. In addition, the selection of a speech synthesizer with a memory depends on which of the sound quality and the memory capacity is first taken into account.

It is an object of the invention to provide a speech synthesizer capable of synthesizing speech on the basis of speech parameters of the type in which a plurality of different amounts of information per unit time are used.

DISCLOSURE OF THE INVENTION

In accordance with this invention there is provided a speech synthesizer in which the waveform of natural speech is chopped at constant time intervals, and n PARCOR coefficients are derived from the chopped waveforms and used to change a filter at constant intervals of time thereby forming a speech to be outputted, in which case, the intervals at which the material waveform is chopped upon extraction of PARCOR coefficients and the synthesizing intervals upon synthesis are simultaneously changed without varying the quantization bits of speech parameters including n PARCOR coefficients distributed to constant time intervals, thereby changing the amount of information per unit time to be used for the synthesis, and thus each part of the speech can be synthesized on the basis of speech parameters of the type in which a plurality of different amounts of information per unit time are used.

BEST MODE FOR CARRING OUT THE INVENTION

Figure 1:
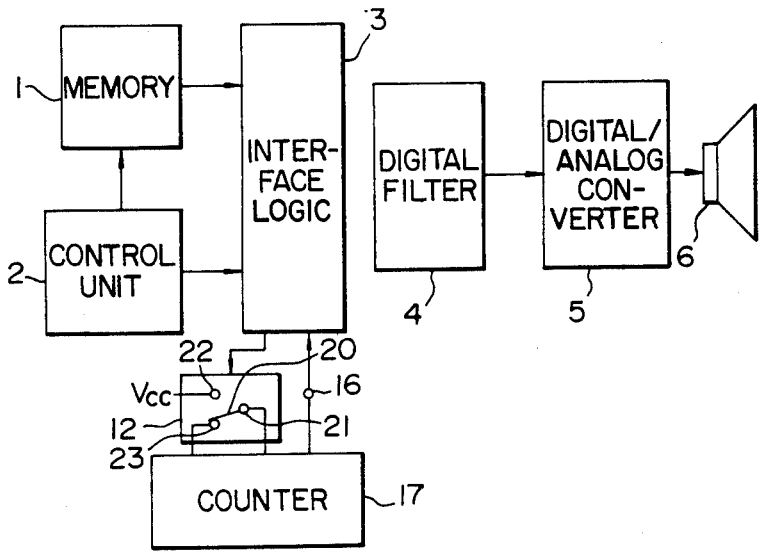
FIG. 1. is a block diagram of one embodiment of the speech synthesizer according to the invention.

FIG. 1 is a block diagram of one embodiment of the speech synthesizer according to the invention. Reference numeral 1 represents a memory in which speech parameters are stored, and 2 a control unit for specifying the address of a speech parameter to be outputted from the memory 1, controlling speech synthesis to start and end, and specifying the transfer rate of the speech parameters. The memory 1 is formed of, for example, a semiconductor memory and stores such speech parameters as amplitude information indicative of speech amplitude, pitch information corresponding to the fundamental vibration frequency of vocal chords and ten PARCOR coefficients. The amount of information per frame to be stored in the memory 1 is 7 bits of amplitude information, 7 bits of pitch information, and 82 bits of 10 PARCOR coefficients, totalling 96 bits of information. The control unit 2 is formed of, for example, a microcomputer and produces control signals for specifying the address of a speech parameter to be outputted, start and end of speech synthesis and so on so that the speech parameters stored in the memory 1 are outputted in turn from the memory 1. These control signals are applied to the memory 1. Then, the control memory 1 responds to the control signal from the control unit 2 to sequentially read out the amplitude, pitch and PARCOR coefficient in this order and be supplied to an interface logic 3. The interface logic 3 receives a control command signal from the control unit 2, and separates the speech parameters from the memory 1 into amplitude, pitch, and PARCOR coefficient in accordance with the command. In addition, the logic 3 decides voiced or silent sound from the pitch information. If voiced sound is decided, it drives a pulse generator, and if silent is decided, it drives a noise generator. Moreover, for voiced sound, it makes the pulse from the pulse generator change on the basis of the pitch information. Furthermore, the interface logic 3 controls the amplitude of the output signal from the pulse generator or noise generator on the basis of amplitude information and supplies the controlled amplitude as a sound source signal to a digital filter 4 together with the PARCOR coefficient. The digital filter 4 is formed of a 10-stage lattice-type filter, each stage lattice-type filter including two multipliers, a subtractor, an adder, a delay circuit and a loss circuit. The 10 PARCOR coefficients from the interface logic 3 are applied to the 10 lattice-type filter stages of the digital filter 4, where the sound source signal and the PARCOR coefficients are multiplied by each other to produce a digital speech code. This digital speech code produced by the digital filter 4 is applied to a digital/analog converter 5 where it is converted to an analog signal, which is then reproduced by a loudspeaker 6.

The speech parameter stored in the memory 1 is formed of 96 bits per frame. The time of one frame is selected to be 20 msec. Therefore, for synthesis of speech during one second, the interface logic 3 must transfer 4800 bits of information. In order to improve the quality of the synthesized sound, it is necessary to increase the amount of information per unit time. If the time of one frame is selected to be 10 msec with the amount of information per frame being maintained to be 96 bits, the amount of information per second is 9600 bits which can improve the quality of synthesized speech. In other words, if only the frame period is changed with the number of bits per frame kept constant, it is possible to change the amount of transfer of speech parameter per unit time.

Figure 2:
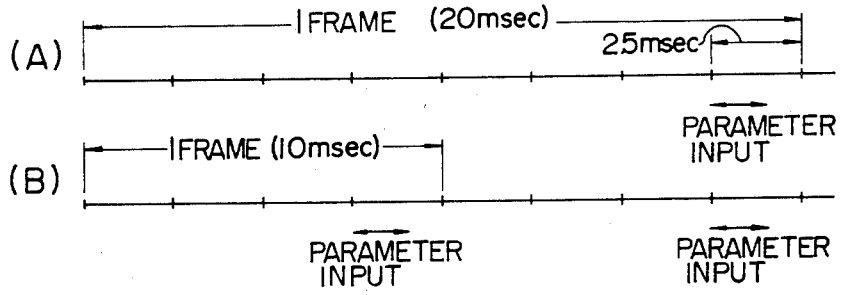
FIG. 2 is a timing chart of the input of the speech parameters.

FIG. 2 is a timing chart of inputting of speech parameter in the speech synthesizer as shown in FIG. 1. FIG. 2A shows the timing for 20 msec of frame and FIG. 2B the timing for 10 msec of frame. The amount of information per frame is 96 bits for either case. If the frame period is halved as shown in FIG. 2B, the amount of information to be transferred per second is doubled. Therefore, the one-frame period of time for speech analysis and synthesis is selected to be 20 msec or 10 msec depending on the degree of calls on telephone channels and a necessary extent of the quality of synthesized sound. In addition, if the speech synthesizer is designed to have a capability of receiving speech parameters with a period changed to be equal to the frame period of inputted or stored speech parameters, processing can be made selectively for the amounts of information of 9600 bits/sec and 4800 bits/sec.

In the memory 1 are stored a speech parameter of 96 bits per frame of 20 m sec and a speech parameter of 96 bits per frame of 10 m sec together, or a selected one of the speech parameters. When a speech parameter is transferred via a telephone channel or the like from externally, the memory 1 stores a speech parameter at a transfer rate selected at this time, that is, 4800 bits/sec or 9600 bits/sec.

The interface logic 3 must change the timing of reception of information in accordance with the amount of transfer of information per unit time at which a speech parameter is transferred from the memory 1.

The interface logic 3 receives one frame of a speech parameter from the memory 1 in 1.2 m sec, and the next frame thereof in the last 2.5 m sec of the frame as shown in the timing chart of FIG. 2. Therefore, a synchronizing signal must be generated at intervals of 10 m sec or 20 m sec for reception of speech parameters. A counter portion 17 generates an input timing signal necessary for the interface logic 3 to receive information and supplies it from its output terminal 16 to the interface logic 3. The period of the input timing signal from the counter portion 17 is changed by a switch portion 12 in accordance with the amount of speech parameters transfer per unit time. The switch portion 12 includes a changeover switch 20 having a movable contact 21 connected to the counter portion 17, a stationary contact 22 connected to the external power supply $V_{cc}$ and the other stationary contact 23 connected to the counter portion 17. When the movable contact 21 is moved to connect to the stationary contact 22, the counter portion 17 produces the input timing signal at intervals of 10 m sec for the amount of information of 9600 bits/ sec. When the movable contact 21 is moved to connect to the other stationary contact 23, the counter portion 17 produces the input timing signal at intervals of 20 m sec for the amount of information 4800 bits/sec.

Thus, the amount of transfer of speech parameters can be changed by only changing the frame with the bit arrangement of the speech parameters unchanged. After the input of the speech parameters, the speech synthesis is always performed independently from the value of the speech parameters. When a speech parameter is inputted, the digital filter 4 is supplied with a new input, to synthesize a digital speech code in turn. The digital speech code is connected by the digital/analog converter 5 to an analog speech signal, which drives the loudspeaker 6 to reproduce a synthesized speech.

Figure 3:
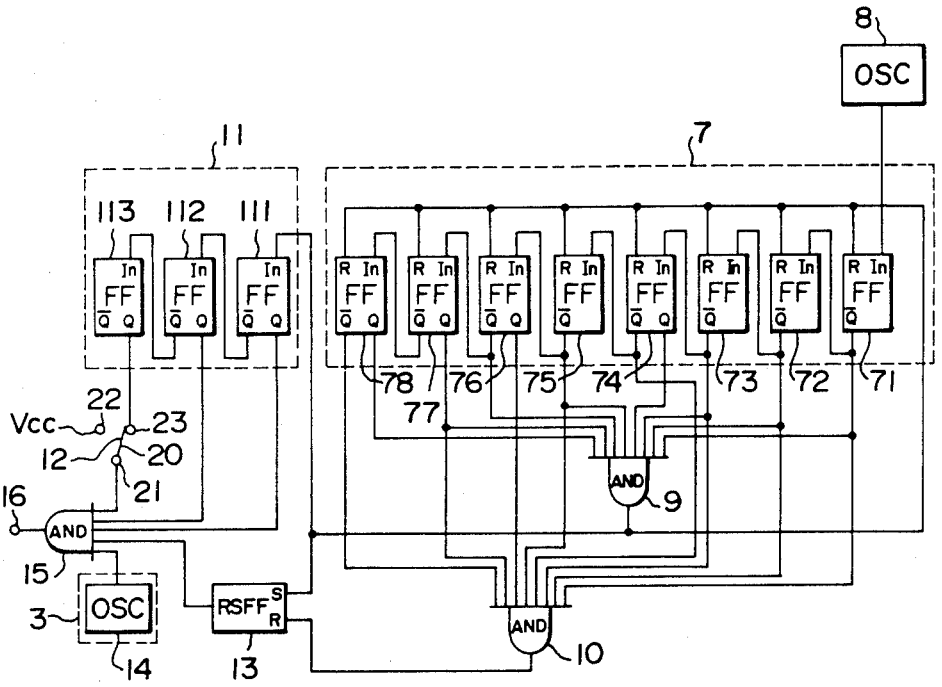
FIG. 3 is a block diagram of one example of the counter for generating an input synchronizing signal to the speech synthesizer according to the invention.

FIG. 3 is a block diagram of one embodiment of the counter portion of the speech synthesizer according to the invention. In FIG. 3, reference numeral 7 represents a first binary counter of 8 stages, for example, 8 flip-flop circuits. The first flip-flop circuit 71 has one output terminal Q is not connected to anything and the other output terminal $\overline{Q}$ connected to the input terminal $I_n$ of the second flip-flop circuit 72 and also to the input terminals of first and second AND circuits 9 and 10. The second flip-flop circuit 72 similarly has its output terminal $\overline{Q}$ connected to the input terminal $I_n$ of the third flip-flop circuit 73 and also to the input terminals of the first and second AND circuits 9 and 10. The third and fifth flip-flop circuits 73 and 75 are also connected similarly as above. The fourth flip-flop circuit 74 has one output terminal Q connected to the input terminal of the first AND circuit 9 and the other output terminal $\overline{Q}$ connected to the input terminal of the second AND circuit 10. The sixth flip-flop circuit 76 has one output terminal Q connected to the input terminal of the second AND circuit 10 and the other output terminal $\overline{Q}$ connected to the input terminal of the first AND circuit 9. The seventh flip-flop circuit 76 has one output terminal Q connected to the input terminals of the first to second AND circuits 9 and 10. The eighth flip-flop circuit 78 has one output terminal Q connected to the input of the first AND circuit 9 and the other output terminal $\overline{Q}$ connected to the input terminal of the second AND circuit 10. The output terminal of the first AND circuit 9 is connected to the reset terminals of the first to eighth flip-flop circuits 71 to 78. The input terminal $I_n$ of the first flip-flop circuit 71 is connected to the first clock generator 8.

Reference numeral 11 represents a second binary counter of three stages, or three flip-flop circuits 111 to 113. The input terminal $I_n$ of the first-stage flip-flop circuit 111 is connected to the output terminal of the AND circuit 9. In addition, the flip-flop circuit 111 has one output terminal Q connected to the input terminal of the third AND circuit 15 and the other output terminal $\overline{Q}$ connected to the input terminal of the second-stage flip-flop circuit 112. The second-stage flip-flop circuit 112 similarly has one output terminal Q connected to the input terminal of a third AND circuit and the other output terminal $\overline{Q}$ connected to the input terminal $I_n$ of the third-stage flip-flop circuit 113. The third-stage flip-flop circuit 113 has one output terminal Q connected to the other stationary contact 23 of the changeover switch 20. The output terminal of the first AND circuit 9 is connected to a set input terminal R of an RS flip-flop circuit 13, and the reset input terminal R of the RS flip-flop circuit 13 is connected to the output terminal of the second AND circuit 10. The output terminal of the flip-flop circuit 13 is connected to the input terminal of the third AND circuit 15, and the other input terminal of the third AND circuit 15 is connected to a second clock pulse generator 14 provided in the interface logic 3. The output terminal of the AND circuit 15 is connected to the output terminal 16.

Let it be described that in this circuit arrangement, speech parameter is transferred at 4800 bits/sec. In this case, the movable contact 21 of the switch 20 is connected to the other stationary contact 23. The first counter 7 counts the clock pulses from the clock pulse generator 8 in turn. When it counts 200 clock pulses, the 8 flip-flop circuits 71 to 78 connected to the input terminal of the AND circuit 9 have their output terminal all at the high level, or "1". Consequently, the AND circuit 9 produces high-level output, or "1", resetting the counter 7. In other words, the AND circuit 9 produces "1" output each time the counter 7 counts 200 pulses from the clock pulse generator 8. This corresponds to the fact that the AND circuit 9 produces output of "1" at intervals of 2.5 m sec. The second counter 11 counts the output of the AND circuit 9. When it counts 8 pulses from the AND circuit 9, the 3 flip-flop circuits 111 to 113 become at high out levels of "1". In other words, the second counter, when counting 8 pulses outputted at intervals of 2.5 m sec from the AND circuit 9, that is, after 20 m sec, supplies high-level signals to the third AND circuit 15. The RS flip-flop circuit 13 is supplied at its set input terminal with the output signal from the AND circuit 9, to be brought to the set condition. Thus, RS flip-flop circuit 13 produces output signal of "1". To the input terminal of the third AND circuit 15 is applied a clock pulse from the clock pulse generator 14. Therefore, when all the 5 input terminals of the third AND circuits 15 become at high level, the third-stage flip-flop circuit 113 of the counter 11 produces high-level output at output terminal Q, that is, just 20 m sec of time has elapsed after the counter portion 17 started to operate. When the counter portion 11 of three flip-flops 111 to 113 counts 8 pulses, the flip-flop circuits 111 to 113 are reset to "0" and ready to again count the next pulse. Thus, after 20 m sec, the third AND circuit is supplied at all the input terminals with high level input, and at this time, the AND circuit 15 produces output of "1" at terminal 16. The signal appearing at the output terminal 16 is supplied to the interface logic 3 in FIG. 1, and the logic 3 receives a speech parameter from the memory 1 while "1" output appears at the output terminal 16.

The second AND circuit 10 is supplied at all the input terminals with high level signal when the first counter 7 counts 96 pulses from the clock pulse generator 8, that is, when 1.2 m sec has elapsed after the counter 7 started to count. Thus, the AND circuit 10 produces "1" signal at its output terminal. The high-level output from the AND circuit 10 is applied to the reset input terminal R of the RS flip-flop circuit 13 to reset it. Therefore, the flip-flop circuit 13 is reset 1.2 m sec after it was set by the output of the AND circuit 9 and hence produces low level output of "0". Consequently, the AND circuit 15 produces "0", causing the interface logic 3 to end the information receiving operation.

Thus, the interface logic 3 operater during the period of 1.2 m sec in which the output of the AND circuit 15 is at high level, to receive 96 pulses of 2.5 $\mu$ sec width each as synchronizing signals for reception of speech parameters.

The rate of information transfer of 9600 bits per sec will hereinafter be described. In this case, the movable contact 21 of the change-over switch 20 is connected to the stationary contact 22. To the stationary contact 22 is applied a positive voltage from a power supply. This voltage is applied via the switch 20 to the input terminal of the AND circuit 15. Thus, when all the input terminals of the AND circuit 15 become at high level, the first and second flip-flop circuits 111 and 112 of the counter 11 produce high level signals of "1" at output terminals Q. In other words, during the period between the fourth and eighth output pulses of the pulses outputted at intervals of 2.5 m sec from the AND circuit 9, the AND circuit 15 produces "1" signal at the output terminal 16. Since the output terminal 16 is at high level during the time of 10 m sec, the interface logic 3 receives speech parameter of 96 bits per frame at intervals of 10 m sec.

Thus, if a speech parameter is transmitted at 96 bits per frame of 20 m sec, the amount of speech parameter for synthesis of speech is 4800 bits per second. If this frame period is halved into 10 m sec, speech parameter of 9600 bits per second can be transferred with 96 bits per frame unchanged. In other words, the bit arrangement of speech parameter is not changed at all, but only the frame period is changed for achieving the amount of transfer of speech parameter.

INDUSTRIAL APPLICABILITY

The speech synthesizer of the invention is applicable to an information service system for providing information such as weather forecasts with continuous speech by way of telephone channels, teaching machines for presenting questions for learning with speech, and so on.

We claim:

1. A speech synthesizer designed to synthesize speech with regard to a selected one of two kinds of speech information whose respective frame periods are different from each other, comprising:

a memory for selectively storing one of first speech information including a first plurality of frames having a first frame period and second speech information including a second plurality of frames having a second frame period which is different from the frame period of the frames of said first speech information, each frame of said first and second speech information having a plurality of bits constituting a digital signal including amplitude information, pitch information and PARCOR coefficient which are extracted from a frequency spectrum of a speech signal, the number of bits constituting said digital signal being the same for all frames;

a control unit for supplying said memory with a command signal for reading out the speech information stored in said memory;

an interface logic for receiving said speech information, from said memory, frame by frame in order and for separating said digital signal into said amplitude information, said pitch information and said parcor coefficient;

a counter portion for generating a first synchronizing signal synchronized with the frame period of the frames of said first speech information and a second synchronizing signal synchronized with the frame period of the frames of said second speech information;

a switch portion for changing the period of said synchronizing signals of said counter portion in accordance with the frame period of the frames of the speech information stored in said memory; and means for applying the synchronizing signals generated by said counter portion to said interface logic;

wherein said counter portion includes a first counter for counting clock pulses to generate a first count output when the number of clock pulses counted thereby reaches a first set count number and to generate a second count output and reset said first counter when the number of clock pulses counted thereby reaches a second set count number that is larger than said first set count numbers, a second counter for counting said second count output to generate a third count output when the number of clock pulses counted thereby reaches a third set count number, a flip-flop which is reset by said first count output and set by said second count output, a logic circuit for forming said synchronizing signals by taking a logic result between a set output of said flip-flop and one of said third count output and a constant voltage from a power supply; and wherein said switch portion selects one of said third count output and the constant voltage from a power supply to be applied to said logic circuit for selection between said synchronizing signals.

* * * * *